US009691318B2

(12) United States Patent
Lu et al.

(10) Patent No.: US 9,691,318 B2
(45) Date of Patent: Jun. 27, 2017

(54) IMAGE DISPLAY METHOD AND DEVICE AND ELECTRONIC APPARATUS

(71) Applicants: BOE Technology Group Co., Ltd., Beijing (CN); Beijing BOE Optoelectronics Technology Co., Ltd., Beijing (CN)

(72) Inventors: Pengcheng Lu, Beijing (CN); Xue Dong, Beijing (CN); Zhongjun Chen, Beijing (CN); Peng Liu, Beijing (CN); Mubing Li, Beijing (CN); Renwei Guo, Beijing (CN); Jinghua Miao, Beijing (CN)

(73) Assignees: BOE Technology Group Co., Ltd., Beijing (CN); Beijing BOE Optoelectronics Technology Co., Ltd., Beijing (CN)

( * ) Notice: Subject to any disclaimer, the term of this patent is extended or adjusted under 35 U.S.C. 154(b) by 0 days.

(21) Appl. No.: 14/789,395

(22) Filed: Jul. 1, 2015

(65) Prior Publication Data

US 2016/0253944 A1 Sep. 1, 2016

(30) Foreign Application Priority Data

Feb. 27, 2015 (CN) ..... 2015 1 0090217

(51) Int. Cl.
*G09G 3/20* (2006.01)
*G09G 5/10* (2006.01)
(Continued)

(52) U.S. Cl.
CPC ..... *G09G 3/2003* (2013.01); *G09G 3/3413* (2013.01); *G09G 5/026* (2013.01);
(Continued)

(58) Field of Classification Search
CPC combination set(s) only.
See application file for complete search history.

(56) References Cited

U.S. PATENT DOCUMENTS

2007/0112714 A1* 5/2007 Fairweather ..... G06F 8/427 706/46
2008/0266329 A1* 10/2008 Park ..... G09G 3/2003 345/690
(Continued)

FOREIGN PATENT DOCUMENTS

CN 1658110 A 8/2005
CN 101162572 A 4/2008
(Continued)

OTHER PUBLICATIONS

Aug. 15, 2016—(CN) First Office Action Appn 201510090217.0 with English Tran.

*Primary Examiner* — Wesner Sajous
(74) *Attorney, Agent, or Firm* — Banner & Witcoff, Ltd.

(57) ABSTRACT

An image display method, device and electronic apparatus avoid to some extent a problem of a poor display effect due to adjusting an image purely depending on an RGB image conversion algorithm. The solution comprises obtaining a brightness value of current ambient light; performing image conversion on a frame of image having three primary color components to obtain a first display information, the first display information comprising four primary color gray scale values of each pixel in the image; adjusting the first display information to a second display information according to the brightness value, the second display information comprising four primary color gray scale values of each adjusted pixel; and displaying the image according to the second display information.

9 Claims, 8 Drawing Sheets

(51) Int. Cl.
*G09G 3/34* (2006.01)
*G09G 5/02* (2006.01)

(52) U.S. Cl.
CPC ..... *G09G 5/10* (2013.01); *G09G 2320/0242* (2013.01); *G09G 2340/06* (2013.01); *G09G 2360/144* (2013.01)

(56) References Cited

U.S. PATENT DOCUMENTS

| | | | | |
|---|---|---|---|---|
| 2009/0022395 | A1* | 1/2009 | Cho | H04N 1/6027 382/167 |
| 2009/0167657 | A1* | 7/2009 | Tomizawa | G09G 3/2003 345/88 |
| 2009/0273607 | A1* | 11/2009 | Ueki | G09G 3/2003 345/590 |
| 2010/0033456 | A1 | 2/2010 | Yoshida et al. | |
| 2010/0091032 | A1* | 4/2010 | Ueki | G09G 3/2003 345/590 |
| 2011/0205257 | A1* | 8/2011 | Seta | G09G 3/3611 345/690 |
| 2014/0267442 | A1* | 9/2014 | Lin | G09G 3/3208 345/690 |
| 2015/0347858 | A1* | 12/2015 | Johnson | G06K 9/033 382/311 |
| 2015/0371605 | A1* | 12/2015 | Wu | G09G 5/02 345/604 |

FOREIGN PATENT DOCUMENTS

| | | | |
|---|---|---|---|
| CN | 101887681 | A | 11/2010 |
| CN | 102194429 | A | 9/2011 |

* cited by examiner

IMAGE DISPLAY METHOD AND DEVICE AND ELECTRONIC APPARATUS

This application claims priority to Chinese Patent Application No. 201510090217.0 filed on Feb. 27, 2015. The present application claims priority to and the benefit of the above-identified application and is incorporated herein in its entirety.

TECHNICAL FIELD OF THE INVENTION

The present disclosure relates to an image display method and device and an electronic apparatus.

BACKGROUND OF THE INVENTION

A display apparatus, such as an LED (Light Emitting Diode) display substrate, etc., in an electronic apparatus can be used for displaying information input by a user or provided to a user, providing a rich visual output to the user.

In a known image outputting process, by taking an RGB (Red-Green-Blue) image as an example, the electronic apparatus converts RGB image information to be output into RGBX (Red-Green-Blue-X) image information by using an RGB image conversion algorithm, the converted RGBX image information containing information of such a total of four fundamental colors as red, green, blue and the fourth color, and then, an image is displayed on a display apparatus based on the RGBX image information.

However, in the above mentioned image outputting process, there are a variety of factors that influence image display quality, and adjusting a display effect of an image in a display apparatus purely by using an RGB image conversion algorithm is unable to guarantee the display effect of the image in different application scenarios. For example, when light is relatively strong, since only information of such a total of four fundamental colors as red, green, blue and the fourth color is taken into account in the output image, which results in the brightness of the output image being relatively dark, a relatively good display effect of the image can not be guaranteed.

SUMMARY OF THE INVENTION

An embodiment of the present invention provides an image display method and device and an electronic apparatus.

In a first aspect, an embodiment of the present disclosure provides an image display method, comprising: obtaining a brightness value of current ambient light; performing image conversion on a frame of an image having three primary color components to obtain a first display information, the first display information comprising four primary color gray scale values of each pixel in the image; adjusting the first display information to a second display information according to the brightness value, the second display information comprising four primary color gray scale values of each adjusted pixel; and displaying the image according to the second display information.

In conjunction with the first aspect, in a first possible implementation of the first aspect, adjusting the first display information to the second display information according to the brightness value comprises increasing at least one primary color gray scale value of each pixel in the first display information to obtain the second display information if the brightness value is greater than a first threshold; and decreasing at least one primary color gray scale value of each pixel in the first display information to obtain the second display information if the brightness value is less than the first threshold.

In conjunction with the first aspect, in a second possible implementation of the first aspect, after adjusting the first display information to the second display information based on the brightness value, it further comprises calculating a first backlight parameter based on the brightness value and the first display information, the first backlight parameter being used for controlling backlight brightness of an electronic apparatus; and adjusting the backlight brightness of the electronic apparatus based on the first backlight parameter.

In conjunction with the second possible implementation of the first aspect, in a third possible implementation of the first aspect, after calculating the first backlight parameter based on the brightness value and the first display information, it further comprises adjusting the first backlight parameter to a second backlight parameter based on the first display information and the second display information, the second backlight parameter being used for controlling the backlight brightness of the electronic apparatus; and adjusting the backlight brightness of the electronic apparatus based on the second backlight parameter.

In conjunction with the third possible implementation of the first aspect, in a fourth possible implementation of the first aspect, adjusting the first backlight parameter to a second backlight parameter based on the first display information and the second display information comprises calculating average difference values between the four primary color gray scale values in the first display information and the four primary color gray scale values in the second display information of all the pixels in the image; decreasing the first backlight parameter to the second backlight parameter if the average difference value of at least one primary color gray scale value is greater than a second threshold; and increasing the first backlight parameter to the second backlight parameter if the average difference value of at least one primary color gray scale value is less than the second threshold.

In a second aspect, an embodiment of the present disclosure provides an image display device, comprising an ambient light detecting unit for obtaining a brightness value of current ambient light; an image conversion unit for performing image conversion on a frame of an image having three primary color components to obtain a first display information, the first display information comprising four primary color gray scale values of each pixel in the image; a display information adjusting unit for adjusting the first display information in the image conversion unit to a second display information according to the brightness value in the ambient light detecting unit, the second display information comprising four primary color gray scale values of each adjusted pixel; and an image output unit for displaying the image according to the second display information in the display information adjusting unit.

In conjunction with the second aspect, in a first possible implementation of the second aspect, the display information adjusting unit is used for increasing at least one primary color gray scale value of each pixel in the first display information to obtain the second display information if the brightness value is greater than a first threshold; and decreasing at least one primary color gray scale value of each pixel in the first display information to obtain the second display information if the brightness value is less than the first threshold.

In conjunction with the second aspect, in a second possible implementation of the second aspect, the electronic apparatus further comprises a backlight parameter determining unit, wherein the backlight parameter determining unit is used for calculating a first backlight parameter based on the brightness value in the ambient light detecting unit and the first display information in the image conversion unit, the first backlight parameter being used for controlling backlight brightness of the electronic apparatus.

In conjunction with the second possible implementation of the second aspect, in a third possible implementation of the second aspect, the electronic apparatus further comprises a backlight adjusting unit, wherein the backlight parameter determining unit is further used for adjusting the first backlight parameter to a second backlight parameter based on the first display information in the image conversion unit and the second display information in the display information adjusting unit, the second backlight parameter being used for controlling the backlight brightness of the electronic apparatus; the backlight adjusting unit is used for adjusting the backlight brightness of the electronic apparatus based on the second backlight parameter in the backlight parameter determining unit.

In conjunction with the third possible implementation of the second aspect, in a fourth possible implementation of the second aspect, the backlight parameter determining unit is used for calculating average difference values between the four primary color gray scale values in the first display information and the four primary color gray scale values in the second display information of all the pixels in the image; decreasing the first backlight parameter to the second backlight parameter if the average difference value of at least one primary color gray scale value is greater than a second threshold; and increasing the first backlight parameter to the second backlight parameter if the average difference value of at least one primary color gray scale value is less than the second threshold.

In a third aspect, an embodiment of the present disclosure provides an electronic apparatus, the electronic apparatus comprising the image display device as described in any possible implementation of the first to fourth possible implementations of the second aspect and the second aspect.

The embodiment of the present disclosure provides an image display method and device and an electronic apparatus. A first display information of an image after an image conversion is adjusted to a second display information by obtaining a brightness value of current ambient light to combine with the brightness value, wherein both the first display information and the second display information comprise four primary color gray scale values of each pixel in the image. Finally, the image is displayed according to the adjusted second display information. As can be seen, because the first display information is adjusted to the second display information considering the brightness value so that the image to be output based on the second display information can be adjusted based on the variation of the brightness value, the problem of a poor display effect due to adjusting an image purely depending on an RGB image conversion algorithm is avoided to some extent.

BRIEF DESCRIPTION OF THE DRAWINGS

In order to more clearly describe an embodiment of the present invention or a technical solution in the related art, drawings needed to be used by the embodiment or the related art will be introduced simply below.

DETAILED DESCRIPTION OF EMBODIMENTS OF THE INVENTION

In the following description, for the purpose of illustration instead of limitation, there is provided details such as a specific system structure, an interface, a technique and like, so as to understand the present disclosure thoroughly. However, the skilled person in the art should understand that the present disclosure can also be implemented in other embodiments without these details. In other cases, detailed description for a well known device, circuit and method are omitted so as to avoid unnecessary details from obscuring the description of the present disclosure.

In addition, terms "first" and "second" are only used for the purpose of illustration, and can not be understood as indicating or implying relative importance or implicitly showing the number of the indicated technical features. Thereby, the features defined by "first" and "second" can expressively or implicitly comprise one or more of the features. In the description of the present disclosure, unless otherwise indicated, the meaning of "a plurality of" is two or more.

Figure 1:
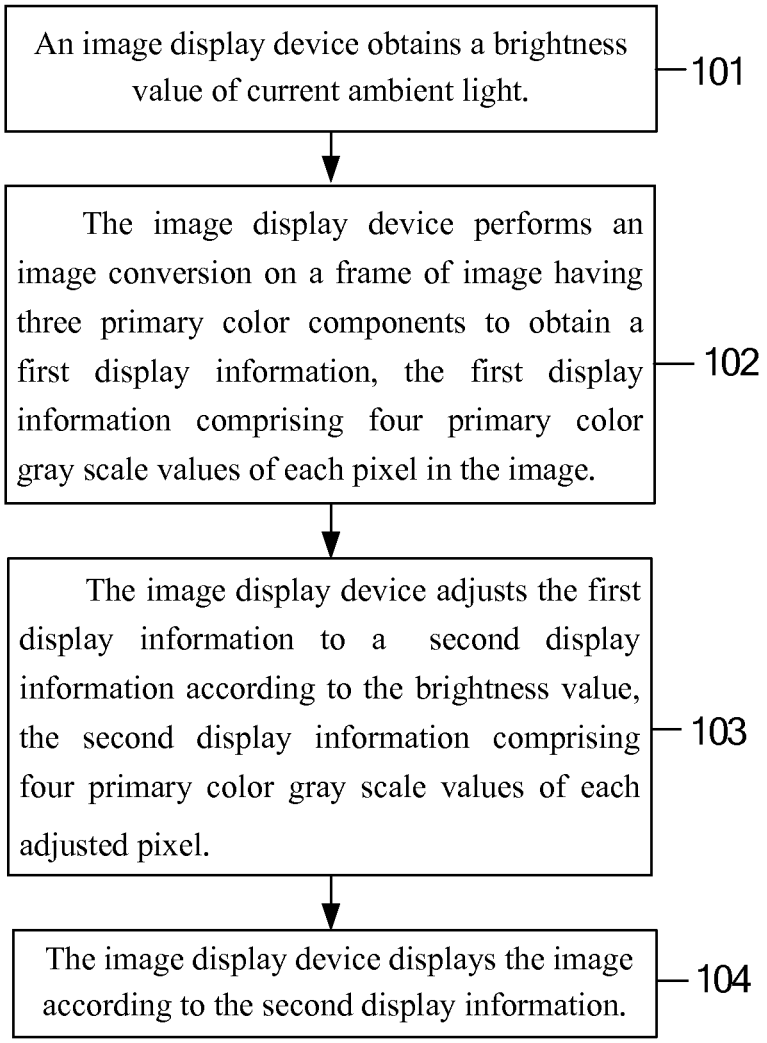
FIG. 1 is a schematic diagram 1 of an image display method provided by an embodiment of the present disclosure.

An embodiment of the present disclosure provides an image display method, as shown in FIG. 1, comprising the following steps:

101. The image display device obtains a brightness value of current ambient light.

102. The image display device performs an image conversion on a frame of an image having three primary color components to obtain a first display information, the first display information comprising four primary color gray scale values of each pixel in the image.

103. The image display device adjusts the first display information to a second display information according to the brightness value, the second display information comprising four primary color gray scale values of each adjusted pixel.

104. The image display device displays the image according to the second display information.

Wherein, a light sensor such as an ambient light sensor, which can adjust the brightness of the image display device according to the light and dark of the ambient light, can be provided in the image display device.

Exemplarily, in step 101, the image display device obtains a brightness value of the current ambient light periodically through a light sensor. The brightness value of the current light can be divided into several levels, or the brightness value of the current light can be embodied in the magnitude of the value.

For example, assuming the brightness value of the ambient light is 0-100, then it can be specified that there is no ambient light when the brightness value is 0, and correspondingly that the brightness of the ambient light is the greatest when the brightness value is 100.

In step 102, the image display device performs an image conversion on a frame of an image having three primary color components to obtain a first display information, the first display information comprising four primary color gray scale values of each pixel in the image.

Wherein, an image to be output comprises a plurality of pixels, and each pixel comprises three primary colors of red, green and blue. When displaying the image, the image display device will decompose each pixel into respective primary colors, and in turn display each pixel on the image display device based on the gray scale values of the respective primary colors, the visual output finally presented to human eyes being the whole image.

It can be seen that the gray scale values of respective primary colors of each pixel need to be determined when an image is displayed. Therefore, the image display device needs to perform an image conversion on a frame of an image having three primary color components, which is converted into an image with four primary color components, and obtains the four primary color gray scale values of each pixel, i.e., a red gray scale value, a green gray scale value, a blue gray scale value and a fourth color gray scale value (the fourth color can be any color other than red, green and blue). In the present application, the four primary color gray scale values of each pixel in an image are referred to as a first display information.

It should be indicated that step 102 can be executed before or after step 101, and there is no logical sequence requirement therebetween.

In step 103, after the image display device obtains the brightness value in step 101 and the first display information in step 102, the image display device adjusts the first display information to a second display information based on the brightness value, wherein the second display information comprises the four primary color gray scale values of each adjusted pixel.

In the known art, after the image display device obtains respective primary color gray scale values in each pixel, since a plurality of data lines and gate lines are provided on the display substrate of the image display device, a digital-to-analog conversion is performed on the respective primary color gray scale values by changing the voltages of the data lines, and finally respective converted pixels are output on the display substrate to display the image to be output. However, because there are many factors influencing the quality of the output image in the image display device, the method for outputting an image purely depending on the respective primary color gray scale values of the image can not guarantee the display quality of the final output image.

Therefore, in the embodiment provided by the present disclosure, taking account of the influence of the brightness value of the ambient light on the picture display quality of the image to be output, after the image display device obtains the brightness value in step 101 and the first display information in step 102, the image display device adjusts the first display information based on the brightness value, and obtains a second display information after the adjustment.

Figure 2:
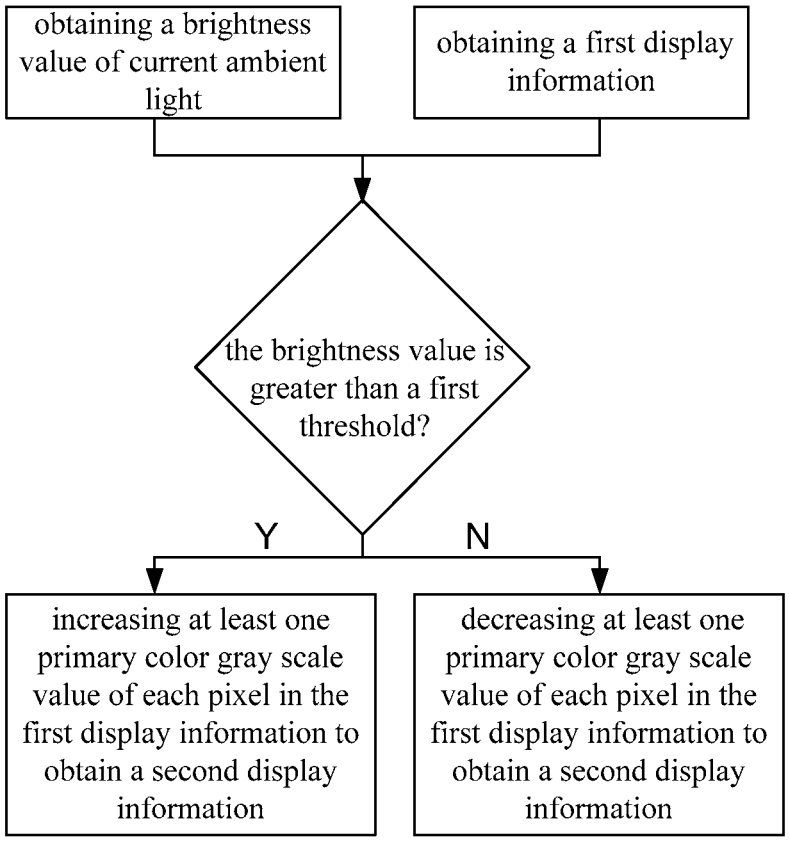
FIG. 2 is a schematic diagram 2 of an image display method provided by an embodiment of the present disclosure.

Exemplarily, as shown in FIG. 2, the image display device compares the brightness value with a preset first threshold. If the brightness value is greater than the first threshold, the image display device increases at least one primary color gray scale values of each pixel in the first display information to obtain the second display information; correspondingly, if the brightness value is less than the first threshold, the image display device decreases at least one primary color gray scale values of each pixel in the first display information to obtain the second display information.

As can be seen, when the brightness value is greater than the first threshold, i.e. the light is relatively strong, in the adjusted second display information obtained by the image display device, at least one primary color gray scale value is increased. As such, the brightness of the image to be output is increased, and in turn the picture display quality of the image to be output under strong light is enhanced. When the brightness value is less than the first threshold, i.e. the light is relatively weak, in the adjusted second display information obtained by the image display device, at least one primary color gray scale value is decreased. As such, the brightness of the image to be output is decreased, and in turn the picture display quality of the image to be output under weak light is enhanced. Because the brightness of the image to be output is adjusted in time, the accuracy of the brightness of the image to be output can be guaranteed, thus minimizing power consumption of the image display device.

Of course, there can be a plurality of methods for the image display device to adjust the first display information to the second display information according to the brightness value, which will be detailed in the subsequent embodiments, no repeated description being given here again.

Finally, in step 104, the image display device performs a digital-to-analog conversion on the four primary color gray scale values of each pixel in the second display information based on the second display information, and finally outputs on the display substrate the respective converted pixels to display the image to be output.

The embodiment of the present disclosure provides an image display method. A first display information of an image after an image conversion is adjusted to a second display information by obtaining a brightness value of current ambient light to combine with the brightness value, wherein both the first display information and the second display information comprise four primary color gray scale values of each pixel in the image. Finally, the image is displayed according to the adjusted second display information. As can be seen, because the first display information is adjusted to the second display information considering the brightness value so that the image to be output based on the second display information can be adjusted based on the variation of the brightness value, the problem of a poor display effect due to adjusting an image purely depending on an RGB image conversion algorithm is avoided to some extent.

Figure 3:
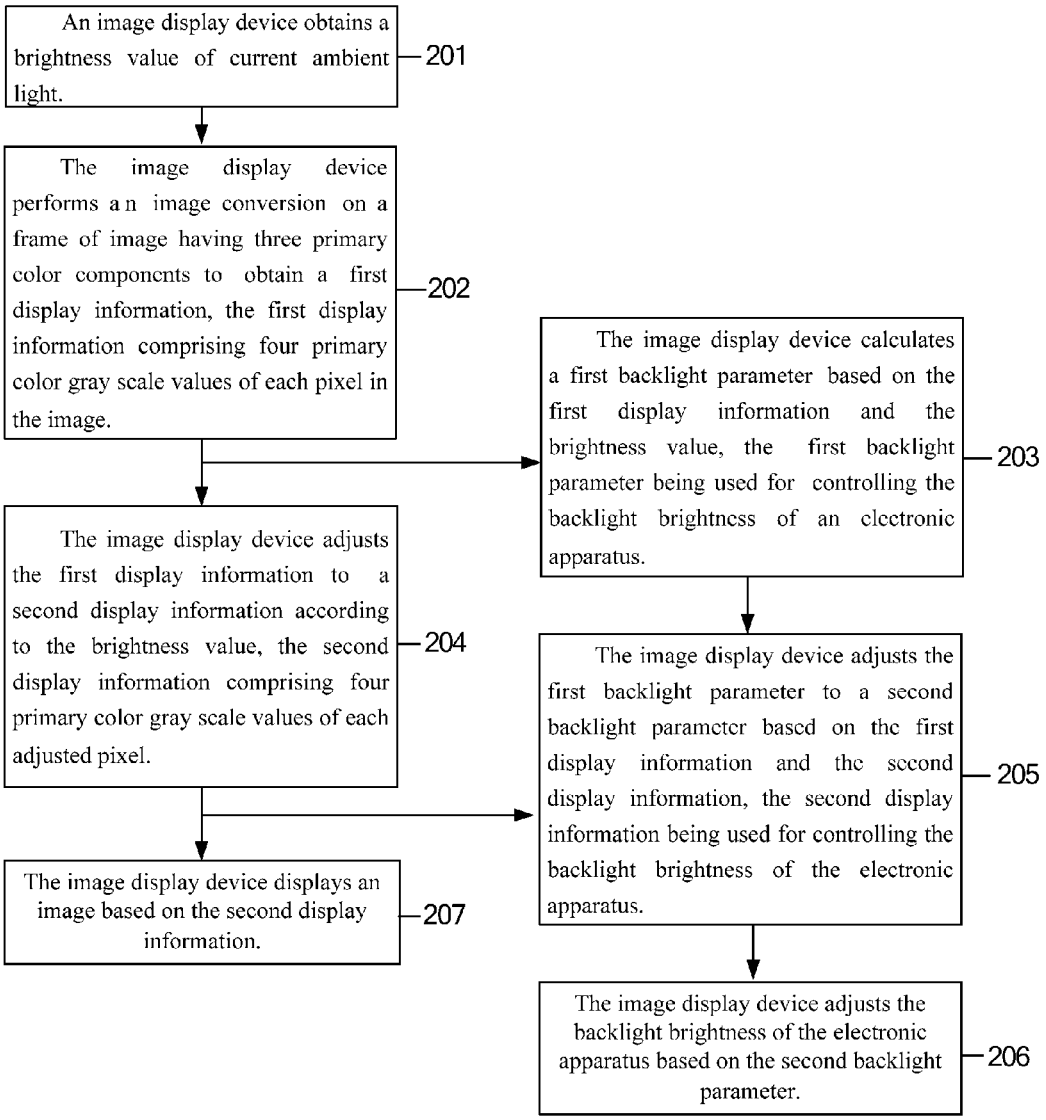
FIG. 3 is a schematic diagram 3 of an image display method provided by an embodiment of the present disclosure.

An embodiment of the present disclosure provides an image display method as shown in FIG. 3, comprising the following steps:

201. An image display device obtains a brightness value of current ambient light.

202. The image display device performs an image conversion on a frame of an image having three primary color components to obtain a first display information, the first display information comprising four primary color gray scale values of each pixel in the image.

203. The image display device calculates a first backlight parameter based on the first display information and the brightness value, the first backlight parameter being used for controlling the backlight brightness of an electronic apparatus.

204. The image display device adjusts the first display information to a second display information according to the brightness value, the second display information comprising four primary color gray scale values of each adjusted pixel.

205. The image display device adjusts the first backlight parameter to a second backlight parameter based on the first display information and the second display information, the second backlight parameter being used for controlling the backlight brightness of the electronic apparatus.

206. The image display device adjusts the backlight brightness of the electronic apparatus based on the second backlight parameter.

207. The image display device displays an image based on the second display information.

In step 201, the image display device obtains a brightness value of the current ambient light periodically through a light sensor, which can refer to step 101.

In step 202, the image display device performs an image conversion on a frame of an image having three primary color components to obtain a first display information, the first display information comprising four primary color gray scale values of each pixel in the image, which can refer to step 102.

Exemplarily, taking an RGB image as an example, the RGB image contains a plurality of RGB pixels, and each RGB pixel includes three primary colors, i.e., red, green and blue. The image display device performs an image conversion on the RGB image, which is converted into an RGBX image, and a pixel of each RGBX image includes four primary colors, i.e., red, green, blue and a fourth primary color. Therefore, the first display information after the image conversion contains a red gray scale value, a green gray scale value, a blue gray scale value and a fourth gray scale value.

In step 203, after the image display device obtains the first display information of each pixel, the image display device can calculate the first backlight parameter based on the first display information and the brightness value, the first backlight parameter being used for controlling the backlight brightness of the electronic apparatus.

In the known art, when controlling the backlight brightness of the electronic apparatus, the image display device usually adjusts the backlight brightness based on the detected brightness value. For example, the backlight brightness is increased under a strong light environment, thus increasing the brightness of the screen, and allowing a user to see the image to be output clearly; the backlight brightness is decreased under a weak light environment, thus decreasing the brightness of the screen, and allowing a user not to feel dazzling. However, when the brightness of the image to be output is very high, the user can see the image to be output clearly under the strong light environment without increasing the backlight brightness of the image display device. At this time, increasing the backlight brightness not only can not enhance the picture quality of the image to be output, but also on the contrary increases the power consumption of the electronic apparatus.

In the embodiment provided by the present disclosure, after obtaining the brightness value in step 201, the image display device refers to the first display information obtained in step 202, to calculate the first backlight parameter for controlling the backlight brightness of the electronic apparatus.

Exemplarily, there are many methods for the image display device to determine the first backlight parameter based on the first display information and the brightness value. For example, when the first display information is within a range of a first threshold, and the brightness value is within a range of a second threshold, set the first backlight parameter to be C1; when the first display information is greater than the range of the first threshold, and the brightness value is within the range of the second threshold, set the first backlight parameter to be C1-x (x is a constant). Or a ratio C2 of the first display information to the brightness value is calculated, and the value of the first backlight parameter can be a value of a function with C2 as a dependent variable. The present disclosure makes no definition thereto.

In step 204, after the image display device obtains the brightness value in step 201 and the first display information in step 202, the image display device adjusts the first display information to a second display information based on the brightness value, the second display information comprising four primary color gray scale values of each adjusted pixel, which can refer to step 103.

Exemplarily, still using the example in step 202, and assuming that in an RGBX image after the image conversion, a red gray scale value is R1, a green gray scale value is G1, a blue gray scale value is B1, and a gray scale value of a fourth sub-pixel is X1, the image display device compares the brightness value with a preset first threshold. If the brightness value is greater than the first threshold, the image display device increases the gray scale values of respective sub-pixels in the first display information, the increased four primary color gray scale values of each pixel being as follows: the red gray scale value is R2 (R2>R1), the green gray scale value is G2 (G2>G1), the blue gray scale value is B2(B2>B1), and the fourth gray scale value is X2(X2>X1). Correspondingly, if the brightness value is less than the first threshold, the image display device decreases the gray scale values of respective sub-pixels in the first display information. In the RGBX image after the decrease, the red gray scale value is R2(R2<R1), the green gray scale value is G2(G2<G1), the blue gray scale value is B2(B2<B1), and the fourth gray scale value is X2(X2<X1).

For another example, when R1 in the first display information is increased to R2 in the second display information, a function 1 of R2=R1+a (a is a constant) can be used; when G1 in the first display information is increased to G2 in the second display information, a function 2 of G2=G1+b (b is a constant) can be used. The present disclosure makes no limitation to the method for adjusting the first display information to the second display information based on the brightness value.

In step 205, after the image display device obtains the second display information, in conjunction with step 203, the image display device can adjust the first backlight parameter to a second backlight parameter based on the first display information and the second display information, the second backlight parameter being used for controlling the backlight brightness of the electronic apparatus.

Figure 4:
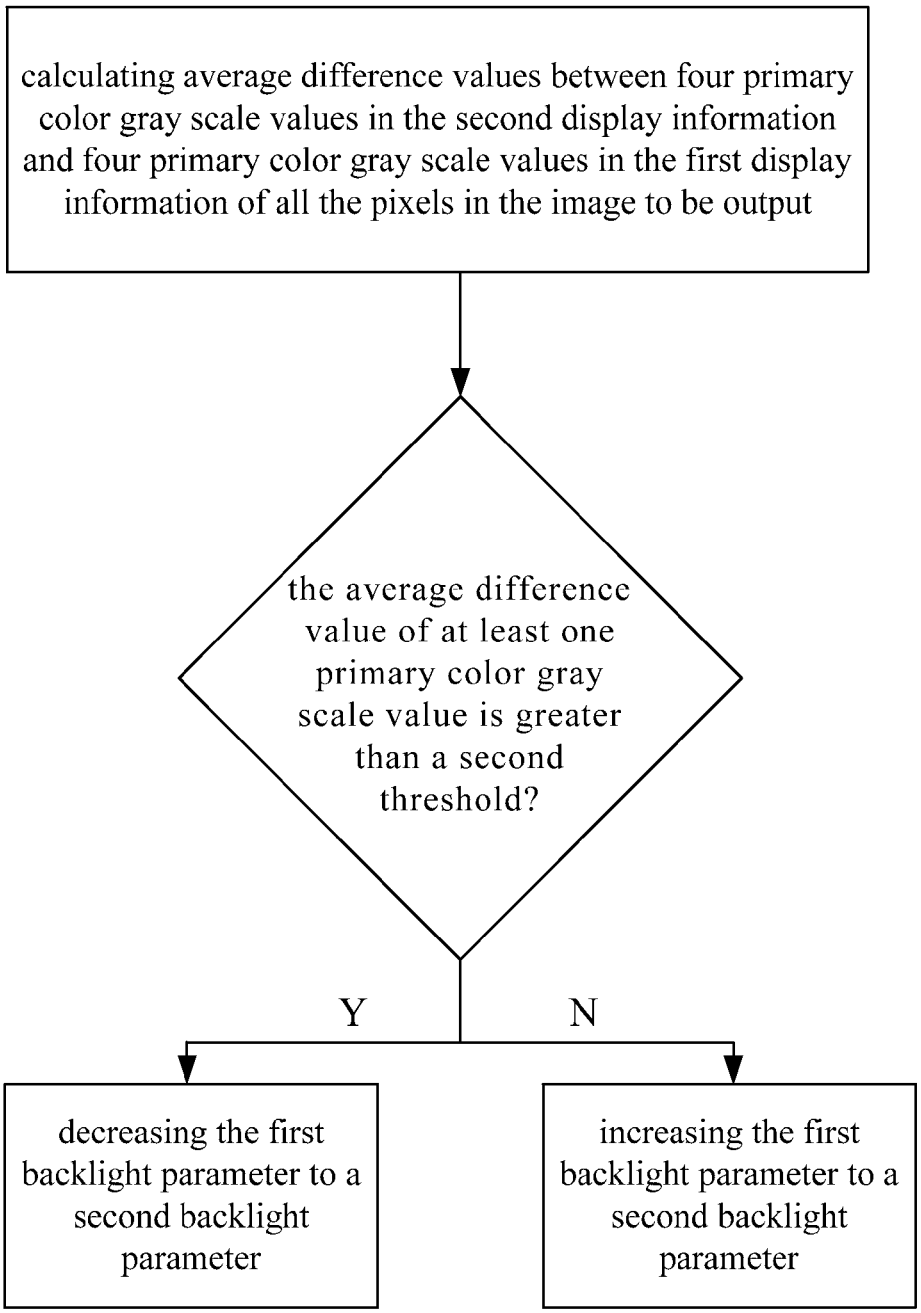
FIG. 4 is a schematic diagram 4 of an image display method provided by an embodiment of the present disclosure.

As shown in FIG. 4, the image display device calculates average difference values between the four primary color gray scale values in the second display information of all the pixels in the image to be output and the four primary color gray scale values in the first display information, and compares the average difference value of each primary color gray scale value with a second threshold. If the average difference value of at least one primary color gray scale value is greater than the second threshold, the image display device decreases the first backlight parameter to a second backlight parameter. If the average difference value of at least one primary color gray scale value is less than the second threshold, the image display device increases the first backlight parameter to the second backlight parameter.

Exemplarily, still using the example in above steps 202 and 203, the image display device calculates gray scale difference values (R2−R1), (G2−G1), (B2−B1) and (X2−X1) of the first pixel, respectively, based on R1, G1, B1, X1 of the first pixel in the first display information and R2, G2, B2, X2 of the first pixel in the second display information. Similarly, the image display device can obtain gray scale difference values of N(N>0) pixels in the image to be output respectively, and in turn calculates an average difference value of red gray scale values, an average difference value of green gray scale values, an average difference value of blue gray scale values and an average difference value of the fourth color gray scale values of N pixels, i.e., averages N (R2−R1), N (G2−G1), N (B2−B1) and N (X2−X1), respectively.

Thus, the image display device can correct the first backlight parameter in step 203 based on the above average difference values of the four color gray scale value. For example, if the average values of three color gray scale difference values in the average difference value of red gray scale values, the average difference value of green gray scale values, the average difference value of blue gray scale values and the average difference value of the fourth color gray scale values are all greater than a second threshold, then it indicated that the brightness indicated by the second display information after the adjustment is relatively high. Therefore, a first backlight parameter (such as Y1) can be decreased to a second backlight parameter Y2 (Y2<Y1), to reduce the power consumption of the electronic apparatus. Correspondingly, if the average difference value of red gray scale values, the average difference value of green gray scale values, the average difference value of blue gray scale values and the average difference value of the fourth color gray scale values are all less than the second threshold, then it indicated that the brightness indicated by the second display information after the adjustment is relatively low. Therefore, a first backlight parameter (such as Y1) can be increased to a second backlight parameter Y2 (Y2>Y1), to guarantee the picture quality of the image to be output.

Of course, the embodiment of the present disclosure is not limited to the method for adjusting the first backlight parameter to the second backlight parameter. For example, the image display device can adjust the first backlight parameter Y1 to the second backlight parameter Y2 based on a preset function with Y1 as an independent variable and Y2 as a dependent variable. The image display device can also determine one of a plurality of preset backlight parameters as an adjusted second backlight parameter based on the second threshold.

In step 206, the image display device adjusts the backlight brightness of the electronic apparatus based on the second backlight parameter obtained in step 205, and achieves a precise tuning of the backlight brightness of the electronic apparatus while reducing the power consumption of the electronic apparatus.

In step 207, the image display device performs a digital-to-analog conversion on the four color gray scale values in the second display information based on the second display information obtained in step 205, and finally outputs respective converted pixels on a display substrate, to display the image to be output.

In addition, the present disclosure does not limit the execution order of step 206 and step 205.

The embodiment of the present disclosure provides an image display method. A first display information of an image after an image conversion is adjusted to a second display information by obtaining a brightness value of current ambient light to combine with the brightness value, wherein both the first display information and the second display information comprise four primary color gray scale values of each pixel in the image. Finally, the image is displayed according to the adjusted second display information. As can be seen, because the first display information is adjusted to the second display information considering the brightness value so that the image to be output based on the second display information can be adjusted based on the variation of the brightness value, the problem of a poor display effect due to adjusting an image purely depending on an RGB image conversion algorithm is avoided to some extent.

Figure 5:
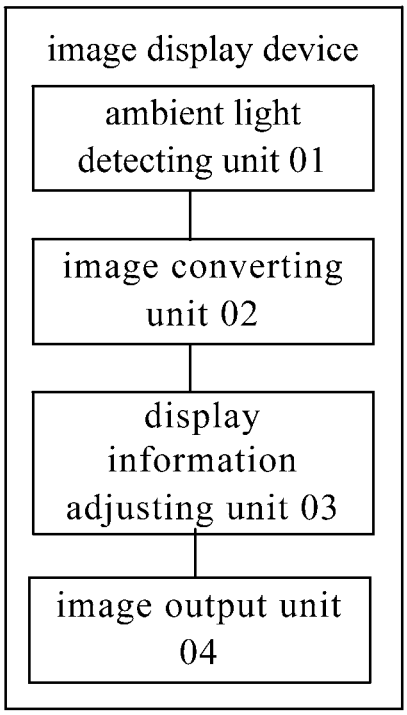
FIG. 5 is a structural schematic diagram 1 of an image display device provided by an embodiment of the present disclosure.

The embodiment of the present disclosure provides an image display device, as shown in FIG. 5, comprising an ambient light detecting unit 01 for obtaining a brightness value of current ambient light; an image conversion unit 02 for performing image conversion on a frame of an image having three primary color components to obtain a first display information, the first display information comprising four primary color gray scale values of each pixel in the image; a display information adjusting unit 03 for adjusting the first display information in the image conversion unit 02 to a second display information according to the brightness value in the ambient light detecting unit 01, the second display information comprising four primary color gray scale values of each adjusted pixel; and an image output unit 04 for displaying the image according to the second display information in the display information adjusting unit 03.

Further, the display information adjusting unit 03 is exemplarily used for increasing at least one primary color gray scale value of each pixel in the first display information to obtain the second display information if the brightness value is greater than a first threshold; and decreasing at least one primary color gray scale value of each pixel in the first display information to obtain the second display information if the brightness value is less than the first threshold.

Figure 6:
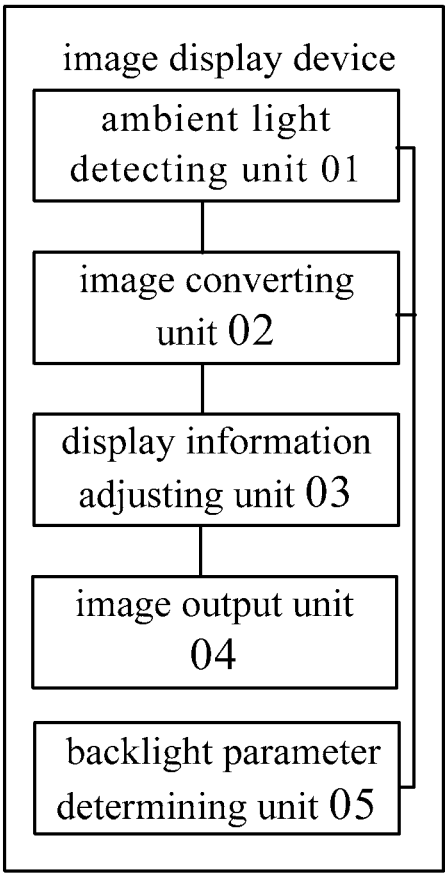
FIG. 6 is a structural schematic diagram 2 of an image display device provided by an embodiment of the present disclosure.

Further, as shown in FIG. 6, the electronic apparatus further comprises a backlight parameter determining unit 05, wherein the backlight parameter determining unit 05 is used for calculating a first backlight parameter based on the brightness value in the ambient light detecting unit 01 and the first display information in the image conversion unit 02, the first backlight parameter being used for controlling the backlight brightness of the electronic apparatus.

Figure 7:
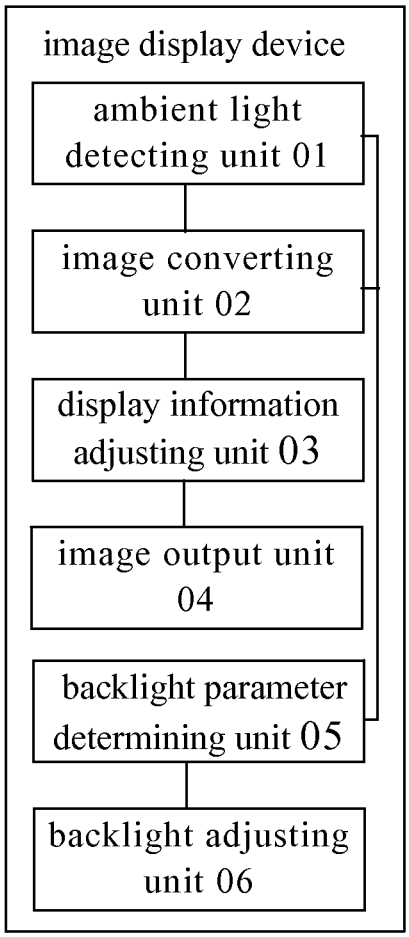
FIG. 7 is a structural schematic diagram 3 of an image display device provided by an embodiment of the present disclosure.

Further, as shown in FIG. 7, the electronic apparatus further comprises a backlight adjusting unit 06, wherein the backlight parameter determining unit 05 is further used for adjusting the first backlight parameter to a second backlight parameter based on the first display information in the image conversion unit 02 and the second display information in the display information adjusting unit 03, the second backlight parameter being used for controlling the backlight brightness of the electronic apparatus; the backlight adjusting unit 06 is used for adjusting the backlight brightness of the electronic apparatus based on the second backlight parameter in the backlight parameter determining unit 05.

Further, the backlight parameter determining unit 05 is exemplarily used for calculating average difference values between the four primary color gray scale values in the second display information and the four primary color gray scale values in the first display information of all the pixels in the image to be output; decreasing the first backlight parameter to a second backlight parameter if the average difference value of at least one primary color gray scale value is greater than the second threshold; and increasing the first backlight parameter to the second backlight parameter if the average difference value of at least one primary color gray scale value is less than the second threshold.

The embodiment of the present disclosure provides an image display device. A first display information of an image after an image conversion is adjusted to a second display information by obtaining a brightness value of current ambient light to combine with the brightness value, wherein both the first display information and the second display information comprise four primary color gray scale values of each pixel in the image. Finally, the image is displayed according to the adjusted second display information. As can be seen, because the first display information is adjusted to the second display information considering the brightness value so that the image to be output based on the second display information can be adjusted based on the variation of the brightness value, the problem of a poor display effect due to adjusting an image purely depending on an RGB image conversion algorithm is avoided to some extent.

Figure 8:
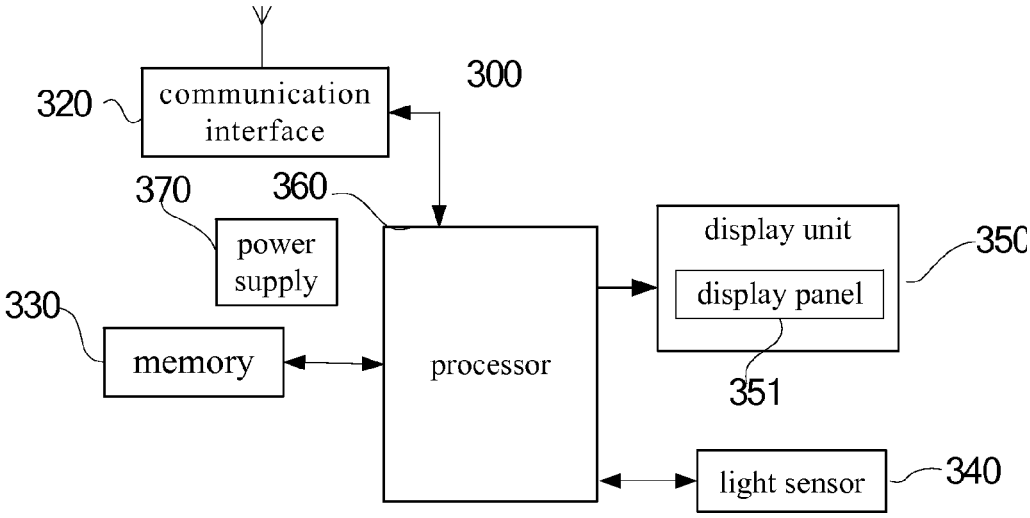
FIG. 8 is a structural schematic diagram of an electronic apparatus provided by an embodiment of the present disclosure.

FIG. 8 is a schematic structural diagram of an electronic apparatus provided by an embodiment of the present disclosure. The electronic apparatus provided by the embodiment of the present disclosure can be used for implementing the methods achieved by the embodiments of the present disclosure as shown in the above FIG. 1 to FIG. 4. In order to facilitate explanation, only parts related to the embodiments of the present disclosure are shown, with the technical details not shown referring to the respective embodiments of the present disclosure as shown in FIG. 1 to FIG. 4.

The electronic apparatus can be such a terminal apparatus as a mobile phone, a tablet PC, a laptop, an UMPC (Ultra-mobile Personal Computer), a netbook, a PDA (Personal Digital Assistant). The embodiment of the present disclosure is described by taking a mobile phone as the electronic apparatus as an example. FIG. 8 shows a block diagram of a part of the structure of the mobile phone 300 related to the respective embodiments of the present disclosure.

As shown in FIG. 8, the mobile phone 300 comprises such components as a communication interface 320, a memory 330, a light sensor 340, a display unit 350, a processor 360, and a power supply 370. Those skilled in the art can understand that the structure of the mobile phone shown in FIG. 8 does not make a limitation to the mobile phone, and it can comprise more or less components or combine certain components or have different component arrangements.

The respective constituting components of the mobile phone 300 will be introduced below in conjunction with FIG. 8.

The communication interface 320 can be used for receiving and transmitting signals and data during operation. The communication interface 320 can provide the received signals and data to the processor 360 for processing. Usually, the communication interface 320 comprises, but is not limited to, an antenna, at least one amplifier, a transceiver, a coupler, an LNA (low noise amplifier) and a duplexer, etc. In addition, the communication interface 320 can further communicate with a network and other apparatuses through wireless communication. The wireless communication can use any communication standard or protocol, including, but not limited to, GSM (global system of mobile communication), GPRS (general packet radio service), CDMA (code division multiple access), WCDMA (wideband code division multiple access), LTE (long term evolution), email, SMS (short messaging service), etc.

The memory 330 is used for storing software programs and modules. The processor 360 executes various functional applications and data processing in the mobile phone 300 by running the software programs and modules stored in the memory 330. The memory 330 can mainly comprise a program storing area and a data storing area, wherein an operation system and application programs required by at least one function (such as a sound playback function, an image playback function, etc.) can be stored in the program storing area; data created based on the use of the mobile phone 300 (such as audio data, image data, phonebook, etc.) can be stored in the data storing area. In addition, the memory 330 may include a high-speed random access memory, or may also include a non-volatile memory, such as at least one magnetic disk storage device, a flash memory device, or other volatile solid-state memory device.

The light sensor 340 can comprise an ambient light sensor and a proximity light sensor. Among them, the ambient light sensor can adjust the brightness of the display unit 350 according to the light and dark of ambient light; the proximity light sensor can detect if there is any object approximating or contacting the mobile phone, and turn off the display unit 350 and/or backlight when the mobile phone 300 approximates to the ear. The mobile phone 300 is further provided with other sensors, such as a gyroscope, a barometer, a hygrometer, a thermometer, an infrared sensor, etc., the description of which will not be repeated here again.

The display unit 350 can be used for displaying information input by a user or information provided to a user and various menus of the mobile phone 300. The display unit 350 may comprise a display panel 351. Optionally, the display substrate can be configured in a form of LCD (Liquid Crystal Display), OLED (Organic Light-Emitting Diode), etc. Although the touch screen and the display substrate 351 in FIG. 8 act as two independent components to implement the input and output functions of the mobile phone 300, in certain embodiments the touch screen can be integrated into the display substrate 351 to implement the input and output functions of the mobile phone 300.

The processor 360 is a control center of the mobile phone 300, connects respective parts of the mobile phone by using various interfaces and lines, and executes various functions of the mobile phone 300 and data processing by running or executing the software programs and/or modules stored in the memory 330 and invoking the data stored in the memory 330, thus overall monitoring the mobile phone. Optionally, the processor 360 may comprise one or more processing units. Exemplarily, the processor 360 may integrate with an application processor and a modem processor, wherein the application processor is mainly used for processing an operation system, a user interface and application programs, while the modem processor is mainly used for processing wireless communication. It can be understood that the above modem processor may not integrated into the processor 360 either.

The mobile phone 300 further comprises a power supply 370 (such as a battery) for supplying power to various components. Exemplarily, the power supply can be connected logically with the processor 360 through a power supply managing system, thus implementing such functions as a charging and discharging management, a power consumption management, etc. through the power supply managing system.

Although not shown, the mobile phone 300 may further comprise a WiFi (wireless fidelity) module, a Bluetooth module, etc., which will not be described here again.

Exemplarily, in the embodiments of the present disclosure, the light sensor 340 obtains a brightness value of ambient light through the communication interface 320, and sends it to the processor 360. The processor 360 performs an image conversion on a frame of image having three primary color components to obtain a first display information, and stores it in the memory 330, the first display information comprising four primary color gray scale values of each pixel in the image. Further, the processor 360 adjusts the first display information to a second display information according to the brightness value, the second display information comprising four primary color gray scale values of each adjusted pixel. Finally, the processor 360 displays the image on the display unit 350 according to the second display information.

Further, the step of "the processor 360 adjusts the first display information into a second display information according to the brightness value" may exemplarily comprises the following steps: if the brightness value is greater than a first threshold, then the processor 360 increases at least one primary color gray scale value of each pixel in the first display information to obtain the second display information; and if the brightness value is less than the first threshold, then the processor 360 decreases at least one primary color gray scale value of each pixel in the first display information to obtain the second display information.

Further, after the processor 360 adjusts the first display information to a second display information according to the brightness value, the following step may further comprised: the processor 360 calculates a first backlight parameter based on the brightness value and the first display information stored in the memory 330, the first backlight parameter being used for controlling the backlight brightness of the mobile phone 300.

Further, after the processor 360 calculates a first backlight parameter based on the brightness value and the first display information stored in the memory 330, the following step may further comprised: the processor 360 adjusts the first backlight parameter into a second backlight parameter based on the first display information and the second display information, the second backlight parameter being used for controlling the backlight brightness of the mobile phone 300. The processor 360 in turn adjusts the backlight brightness of the display unit 350 of the mobile phone 300 based on the second backlight parameter.

Further, the step of "the processor 360 adjusts the first backlight parameter into a second backlight parameter based on the first display information and the second display information" may exemplarily comprises the following steps: the processor 360 calculates average difference values between the four primary color gray scale values in the second display information of all the pixels in the image and the four primary color gray scale values in the first display information; if the average difference value of at least one primary color gray scale value is greater than the second threshold, the image display device 360 decreases the first backlight parameter to a second backlight parameter; if the average difference value of at least one primary color gray scale value is less than the second threshold, the image display device 360 increases the first backlight parameter to the second backlight parameter.

The embodiment of the present disclosure provides an electronic apparatus. A first display information of an image after an image conversion is adjusted to a second display information by obtaining a brightness value of current ambient light to combine with the brightness value, wherein both the first display information and the second display information comprise four primary color gray scale values of each pixel in the image. Finally, the image is displayed according to the adjusted second display information. As can be seen, because the first display information is adjusted to the second display information considering the brightness value so that the image to be output based on the second display information can be adjusted based on the variation of the brightness value, the problem of a poor display effect due to adjusting an image purely depending on an RGB image conversion algorithm is avoided to some extent.

In the description of the present specification, the exemplary features, structures, materials and characteristics can be combined in an appropriate way in any one or more embodiments or examples.

The above description is only specific implementations of the present disclosure, but the protection scope of the present disclosure is not limited thereto. Within the technical scope disclosed by the present disclosure, any of those skilled in the art can readily conceive variations or substitutions which should be covered in the protection scope of the present disclosure. Therefore, the protection scope of the present disclosure should be subject to the protection scope of the claims.

The present application claims the priority of Chinese Patent Application No. 201510090217.0 filed on Feb. 27, 2015, the content of which is referenced here as a portion of the present application in entirety.

What is claimed is:

1. An image display method applied to a display device which comprises an ambient light detector, an image converter, a display information processor, and an image display, the method comprising:

obtaining a brightness value of current ambient light by the ambient light detector;

performing image conversion on a frame of an image having three primary color components by the image converter to obtain first display information, the first display information comprising four primary color gray scale values of each pixel in the image;

adjusting the first display information to second display information according to the brightness value by the display information processor, the second display information comprising four primary color gray scale values of each adjusted pixel; and displaying the image according to the second display information by the image display, wherein after the adjusting the first display information to the second display information based on the brightness value, the method further comprising:

calculating a first backlight parameter based on the brightness value and the first display information, the first backlight parameter being used for controlling backlight brightness of an electronic apparatus; and adjusting the backlight brightness of the electronic apparatus based on the first backlight parameter, and wherein after the calculating the first backlight parameter based on the brightness value and the first display information, the method further comprising:

adjusting the first backlight parameter to a second backlight parameter based on the first display information and the second display information, the second backlight parameter being used for controlling the backlight brightness of the electronic apparatus; and adjusting the backlight brightness of the electronic apparatus based on the second backlight parameter.

2. The image display method according to claim 1, wherein the adjusting the first backlight parameter to the second backlight parameter based on the first display information and the second display information comprises:

calculating average difference values between the four primary color gray scale values in the second display information and the four primary color gray scale values in the first display information of each pixel in the image;

decreasing the first backlight parameter to a second backlight parameter if an average difference value of at least one primary color gray scale value is greater than a second threshold; and increasing the first backlight parameter to the second backlight parameter if an average difference value of at least one primary color gray scale value is less than the second threshold.

3. The image display method according to claim 1, wherein the adjusting the first display information to second display information according to the brightness value comprises:

increasing at least one primary color gray scale value of each pixel in the first display information to obtain the second display information if the brightness value is greater than a first threshold; and, decreasing at least one primary color gray scale value of each pixel in the first display information to obtain the second display information if the brightness value is less than the first threshold.

4. An image display device, comprising:

an ambient light detector for obtaining a brightness value of current ambient light;

an image converter, connected to the ambient light detector, for performing image conversion on a frame of an image having three primary color components to obtain first display information, the first display information comprising four primary color gray scale values of each pixel in the image;

a display information processor, connected to the ambient light detector and the image converter, for adjusting the first display information in the image converter to second display information according to the brightness value obtained by the ambient light detector, the second display information comprising four primary color gray scale values of each adjusted pixel; and an image display connected to the display information processor, for displaying the image according to the second display information in the display information processor, wherein the image display device further comprises:

a backlight parameter determining device which is used for calculating a first backlight parameter based on the brightness value in the ambient light detector and the first display information in the image converter, the first backlight parameter being used for controlling backlight brightness of the image display device, and is further used for adjusting the first backlight parameter to a second backlight parameter based on the first display information in the image converter and the second display information in the display information processor, the second backlight parameter being used for controlling the backlight brightness of the image display device, and a backlight adjuster which is used for adjusting the backlight brightness of the image display device based on the second backlight parameter in the backlight parameter determining device.

5. The image display device according to claim 4, wherein the display information processor is used for increasing at least one primary color gray scale value of each pixel in the first display information to obtain the second display information if the brightness value is greater than a first threshold; and decreasing at least one primary color gray scale value of each pixel in the first display information to obtain the second display information if the brightness value is less than the first threshold.

6. The image display device according to claim 4, wherein the backlight parameter determining device is used for calculating average difference values between the four primary color gray scale values in the first display information and the four primary color gray scale values in the second display information of each pixel in the image;

decreasing the first backlight parameter to the second backlight parameter if an average difference value of at least one primary color gray scale value is greater than a second threshold; and increasing the first backlight parameter to the second backlight parameter if an average difference value of at least one primary color gray scale value is less than the second threshold.

7. An electronic apparatus, comprising the image display device according to claim 4.

8. The electronic apparatus according to claim 7, wherein the backlight parameter determining device is used for calculating average difference values between the four primary color gray scale values in the first display information and the four primary color gray scale values in the second display information of each pixel in the image;

decreasing the first backlight parameter to the second backlight parameter if an average difference value of at least one primary color gray scale value is greater than a second threshold; and increasing the first backlight parameter to the second backlight parameter if an average difference value of at least one primary color gray scale value is less than the second threshold.

9. The electronic apparatus according to claim 7, wherein the display information processor is used for increasing at least one primary color gray scale value of each pixel in the first display information to obtain the second display information if the brightness value is greater than a first threshold; and decreasing at least one primary color gray scale value of each pixel in the first display information to obtain the second display information if the brightness value is less than the first threshold.

* * * * *